US007437115B2

(12) United States Patent
Ohba

(10) Patent No.: US 7,437,115 B2
(45) Date of Patent: Oct. 14, 2008

(54) IMAGE FORMING DEVICE

(75) Inventor: Keisuke Ohba, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 73 days.

(21) Appl. No.: 11/258,903

(22) Filed: Oct. 27, 2005

(65) Prior Publication Data

US 2007/0098420 A1 May 3, 2007

(51) Int. Cl.
*G03G 21/00* (2006.01)
*G03G 15/00* (2006.01)

(52) U.S. Cl. ..... 399/347; 399/44

(58) Field of Classification Search ..... 399/149, 399/347, 346

See application file for complete search history.

(56) References Cited

U.S. PATENT DOCUMENTS 5,740,494 A * 4/1998 Shoji et al. ..... 399/71

6,324,354 B1 * 11/2001 Tode et al. ..... 399/29

* cited by examiner

*Primary Examiner*—David M. Gray
*Assistant Examiner*—David A Blackshire
(74) *Attorney, Agent, or Firm*—Global IP Counselors, LLP

(57) ABSTRACT

An image forming device 30 is constituted capable of executing a refresh mode, including: a toner discharge process that transports toner on a developing sleeve 4*a* inside a developing unit 4 to a photoreceptor drum 1 side when starting up the image forming device from the power supply off state, the sleep (energy saving) mode, and the like, to the copy start state; a transfer roller refresh process that transports the toner transported to the photoreceptor drum 1 side by the toner discharge process to a transfer roller 5 side; and a return process that once again transports the toner transported to the transfer roller 5 side by the transfer roller refresh process to the photoreceptor drum 1 side.

15 Claims, 9 Drawing Sheets

| | | |
|---|---|---|
| PHOTORECEPTOR DRUM | MATERIAL | AMORPHOUS SILICON (30 MM DIA) |
| | SENSITIVITY | V0: 400 V VL: 50V |
| TRANSFER ROLLER | MATERIAL | CONDUCTIVE EPDM FOAM RUBBER (15.75 MM DIA) |
| | RESISTANCE | 7.5th power (log Ω ) |
| | BIAS HAVING A POLARITY THE REVERSE OF THE TONER | −40 A (NORMAL TRANSFER OUTPUT) |
| | | −20 A (DURING TRANSFER ROLLER REFRESH) |
| | BIAS HAVING A POLARITY THE SAME AS THE TONER | +590 V (RETURN PROCESS) |
| DEVELOPING SLEEVE | DEVELOPING BIAS | 200 V |

*Fig. 7*

IMAGE FORMING DEVICE

FIELD OF THE INVENTION

The present invention relates to an image forming method that is used in an electrophotographic method, an electrostatic recording method, an electrostatic printing method, and the like.

BACKGROUND INFORMATION

Generally, in an image forming method that uses an electrophotographic method and the like, toner that deviates from a predetermined charge quantity due to repetitive image forming adheres to the surface of a developing sleeve (toner carrier) without being developed, which inhibits triboelectric charging between the developing sleeve and other toner particles, and is then transported to the electrostatic latent image portion without being uniformly charged on the developing sleeve. This causes problems such as image density reduction and fogging.

Such phenomena are conspicuous particularly when the document print ratio of the image is low. If the document print ratio is low, then toner particles tend to remain on the developing sleeve because little of the toner develops from the developing sleeve to the photoreceptor drum (electrostatic latent image carrier), and therefore fogging and image density reduction tend to occur. Particularly because print patterns having a low print ratio are printed continuously over a long time period in a developing machine, there is an increase in the amount of toner that deviates from a predetermined charge quantity and that is difficult to develop, which causes a drop in density. In such a case, it is possible to develop a large quantity of toner from the developing sleeve to the photoreceptor drum side by a pattern having a high document print ratio, such as a solid black pattern, and then transfer the toner to a recording medium, but this method unfortunately consumes toner; alternatively, in a more preferable method that does not use a recording medium, the toner on the developing sleeve is transported onto the photoreceptor drum when it is not in the process of transferring, and this toner is collected (refresh process) by a cleaning means such as a cleaning blade, thereby making it possible to mitigate the density reduction, fogging, and the like.

Meanwhile, a-Si [(amorphous silicon)] photoreceptor drums are widely used as the image carrier in image forming devices that employ an electrophotographic process. An a-Si photoreceptor drum has a high degree of hardness and excellent durability, and can maintain high image quality as a photoreceptor with virtually no deterioration in its characteristics even after long-term usage; consequently, it is an image carrier that has a low running cost, is easy to handle, and is also quite safe for the environment.

Because of the characteristics of an image forming device that uses such an a-Si photoreceptor drum, it is known that it tends to suffer from image deletion. Namely, the discharge of a charging unit generates ozone when charging [the photoreceptor drum]. This ozone decomposes components in the air, which produces ion products, such as NOx and SOx. Because these ion products are water soluble, they adhere to the photoreceptor drum and penetrate the roughness structure of the surface thereof [to a depth of] approximately 0.1 μm; consequently, the toner cannot be removed by the cleaning system used in a general purpose machine and, furthermore, the resistance of the surface of the photoreceptor drum drops due to the uptake of atmospheric moisture by the toner. Consequently, a cross current of the electric potential flows at the edge of the electrostatic latent image formed on the surface of the photoreceptor drum, which results in image deletion.

Conventionally, energy is applied to separate the moisture taken into the ion products by inserting a heater in the photoreceptor drum, thereby suppressing a drop in the resistance of the surface of the photoreceptor drum in high humidity environments, and such a technique is popularly used in actual machines. Nevertheless, the heater in such a device increases the number of constituent parts, requires space for installation, and increases power consumption, which all lead to an increase in the size and cost of the device. In addition, this approach is unpreferable because it lengthens the time required to heat the photoreceptor surface to a predetermined temperature, and also poses safety concerns.

Consequently, a method with a simple constitution has been proposed that suppresses a drop in the resistance of the surface of the photoreceptor drum and reduces image deletion; as depicted in FIG. 9, a method is disclosed that eliminates ozone products without the use of a heater, and the like, by executing a refresh mode, in accordance with a predetermined timing, that polishes the photoreceptor by the interaction of a polishing means (a sliding friction roller and a cleaning blade) with polishing toner mixed with a polishing agent.

In FIG. 9, a charging unit 2, an exposure unit 3, a developing unit 4, a transfer roller 5, a sliding friction roller 6, a cleaning blade 9, and a charge eliminating device 10 are provided to and arranged in an image forming unit 15 along the rotational direction (the arrow A direction) of a photoreceptor drum 1. The photoreceptor drum 1 is, for example, a photosensitive layer made of a-Si laminated on an aluminum drum, and is constituted so that the charging unit 2 charges the surface. Furthermore, an electrostatic latent image, wherein the charge is attenuated, is formed on the surface where a laser beam impinged from the exposure unit 3. The charging unit 2 charges the surface of the photoreceptor drum 1 by discharging (e.g., corona discharge), and is constituted as an electrode, such as a thin wire, that discharges by the application of a high voltage.

The exposure unit 3 causes an electrostatic latent image to be formed on the surface of the photoreceptor drum 1 by irradiating it with a light beam (e.g., a laser beam) based on image data. The developing unit 4 comprises a developing sleeve 4*a*, which is arranged opposing the photoreceptor drum 1 and adheres a developing agent stored internally to the electrostatic latent image of the photoreceptor drum 1, which causes a toner image to be formed.

As is well known, after the charge is removed by the charge eliminating device 10, the exposure unit 3 records the electrostatic latent image on the photoreceptor drum 1, which has been uniformly charged by the charging unit 2, the developing unit 4 develops that electrostatic latent image to a toner image by reversal development, and the transfer roller 5 transfers the toner image onto a transfer paper 11. The untransferred toner, which was not transferred by the transfer roller 5, is removed as residual toner from the surface of the photoreceptor drum 1 by the sliding friction roller 6 and the cleaning blade 9, and the removed residual toner is transported to a waste bottle (not shown) by a toner recovery device, such as a recovery screw 8.

Reference numeral 14 is a cleaning device that comprises the sliding friction roller 6 and the cleaning blade 9, which constitute a polishing system that polishes the photoreceptor drum 1, and has a spring 7 for pressing the sliding friction roller 6 to the photoreceptor surface under constant pressure. The sliding friction roller 6 comprises a shaft, the circumference of which is covered with a urethane foam rubber. Furthermore, the hardness of this rubber is adjusted to 50 degrees in a state having passed through the shaft. Toners used as the polishing toner include, for example, those wherein a polishing agent, such as titanium oxide, strontium titanate, and alumina, is embedded in the toner particle surface and retained so that it partially protrudes from the surface, and those wherein a polishing agent is electrostatically adhered to the toner [particle] surface.

This technology is an image forming device provided with a constitution that polishes the a-Si photoreceptor drum so that its surface roughness Rz falls below 500 angstroms, and is capable of sufficiently removing ion products of the type discussed above by polishing the drum to this surface roughness, even if the ion products are adhered to the surface of the photoreceptor drum.

In one prior art mentioned above, there is a process wherein a large quantity of toner that is difficult to develop due to the high print ratio pattern is developed from the developing sleeve to the photoreceptor drum side, and wherein a voltage (transfer bias) is not impressed upon the transfer roller 5 so that the discharged toner does not adhere to the transfer roller.

In addition, in another prior art, a voltage (transfer bias) is not impressed upon the transfer roller 5 so that the toner discharged from the developing unit 4 does not adhere to the transfer roller 5 during the refresh mode, which polishes the surface of the photoreceptor drum 1. However, there is a problem in that the components of the transfer roller 5 adhere to the surface of the photoreceptor drum 1 in high temperature and high humidity environments, and appear as image defects. In addition, the transfer roller 5 itself absorbs moisture that gradually adheres to the surface of the photoreceptor drum 1 therefrom; consequently, ion products cannot be sufficiently removed just by the sliding friction roller 6 polishing the surface of the photoreceptor drum 1, which is a problem because image failures, such as image deletion, occur.

The present invention considers such problems; it is an object of the present invention to provide an image forming device that can suppress image defects and image deletion in high temperature and high humidity environments, and that can form high quality images regardless of the environment in which the device is used.

SUMMARY OF THE INVENTION

To achieve the abovementioned objectives, the present invention is an image forming device having an electrostatic latent image carrier, an exposing means that writes an electrostatic latent image onto the surface of the electrostatic latent image carrier, and a developing means that forms a toner image on the electrostatic latent image carrier surface by toner carried on the toner carrier, wherein the visual image obtained by the developing means is transferred onto a recording medium by a transferring means, and is output as an output image through a fusing means, comprising: a process that, during operation outside of the time of forming the output image, transports toner from the toner carrier to the electrostatic latent image carrier side, impresses a voltage having a polarity the reverse of the toner upon the transferring means, and transports to the transferring means side the toner that was transported to the electrostatic latent image carrier side; and a return process that impresses a voltage having a polarity the same as the toner upon the transferring means, and transports to the electrostatic latent image carrier side the toner that was transported to the transferring means side.

In addition, the present invention is an image forming device as constituted above, wherein the transferring means is a transfer roller.

In addition, the present invention is an image forming device as constituted above, comprising: a sliding friction roller that presses against the electrostatic latent image carrier surface under a predetermined pressure, and that slidably rubs against the electrostatic latent image carrier surface; and a process that supplies to the sliding friction roller the toner that was transported to the electrostatic latent image carrier side, and slidably rubs against the electrostatic latent image carrier surface.

In addition, the present invention is an image forming device as constituted above, wherein the supply of the toner to the sliding friction roller is performed continuously at least for the time it takes the sliding friction roller to make one revolution.

In addition, the present invention is an image forming device as constituted above, wherein the impression of the voltage upon the transfer roller, in the process that transports the toner to the transferring means side, is performed continuously for at least the time it takes the transfer roller to make one revolution.

In addition, the present invention is an image forming device as constituted above, wherein the impression of the voltage upon the transfer roller in the return process is performed continuously for at least the time it takes the transfer roller to make three revolutions.

In addition, the present invention is an image forming device as constituted above, comprising a second return process that, after the return process, impresses a voltage having a polarity the reverse of the toner upon the transfer roller.

In addition, the present invention is an image forming device as constituted above, wherein the impression of the voltage upon the transfer roller in the second return process is performed continuously for at least the time it takes the transfer roller to make one revolution.

In addition, the present invention is an image forming device as constituted above, comprising: a detecting means that detects the temperature and/or the humidity of the inside and/or the outside of the device; a process that transports the toner from the toner carrier to the electrostatic latent image carrier side in accordance with the temperature and/or the humidity detected by the detecting means, and transports the transported toner to the transferring means side; and a controlling means that controls whether it is necessary to execute the return process that transports the toner, which was transported to the transferring means side, to the electrostatic latent image carrier side, and that controls the execution time.

In addition, the present invention is an image forming device as constituted above, wherein the electrostatic latent image carrier consists of amorphous silicon.

The present invention according to the first constitution provides a process that, during operation outside of the time of forming the output image, transports toner from the toner carrier to the electrostatic latent image carrier side, impresses a voltage having a polarity the reverse of the toner upon the transferring means, and transports to the transferring means side the toner that was transported to the electrostatic latent image carrier side; and a return process that impresses a voltage having a polarity the same as the toner upon the transferring means, and transports to the electrostatic latent image carrier side the toner that was transported to the transferring means side; consequently, toner that is difficult to develop is discharged from the toner carrier and, simultaneous therewith, the toner can absorb the adherends and moisture on the transferring means; therefore, an excellent image is obtained without image defects even in high temperature and high humidity environments.

The present invention according to the second constitution is an image forming device according to the first constitution, wherein the transferring means is a transfer roller; therefore, the toner that was transported to the transfer roller side can effectively remove the adherends adhered to the transfer roller surface.

The present invention according to the third constitution is an image forming device according to the first or second constitutions, that provides: a process that, by a toner discharge process that transports toner to the electrostatic latent image carrier side, supplies to the sliding friction roller the toner that was transported to the electrostatic latent image carrier side, and slidably rubs against the electrostatic latent image carrier surface; and a process that transports part of the toner to the transferring means; thereby, the adherends on the electrostatic latent image carrier side and on the transferring means can be removed simultaneously and image defects due to adherends, moisture, and the like adhering to the transferring means can be suppressed effectively; furthermore, the residual toner inside the developing unit can be effectively used because the adherends on the electrostatic latent image carrier and the transferring means are removed simultaneous with the process that discharges the difficult-to-develop toner from the toner carrier. In addition, there is no longer a risk of blemishing the reverse side of the paper when forming an image because the return process is provided that retransports the toner on the transferring means to the electrostatic latent image carrier side.

The present invention according to the fourth constitution is an image forming device according to the first through third constitutions, wherein the supply of the toner to the sliding friction roller is performed continuously at least for the time it takes the sliding friction roller to make one revolution; thereby, it is possible to adhere toner to the entire sliding friction roller and sufficiently polish the surface of the photoreceptor drum.

In addition, the present invention according to the fifth constitution is an image forming device according to the first through fourth constitutions, wherein the impression of the voltage upon the transfer roller, in the process that transports the toner to the transferring means side, is performed continuously for at least the time it takes the transfer roller to make one revolution; thereby, it is possible to adhere toner to the entire transfer roller and reliably absorb the moisture on the surface of the transfer roller surface.

In addition, the present invention according to the sixth constitution is an image forming device according to any one of the first through fifth constitutions, wherein the impression of the bias voltage upon the transfer roller in the return process is performed continuously for at least the time it takes the transfer roller to make three revolutions; thereby, it is possible to sufficiently return the toner, which adhered to the transfer roller, to the photoreceptor drum side.

In addition, the present invention according to the seventh constitution is an image forming device according to any one of the first through sixth constitutions, comprising: a second return process that, after the return process, impresses the bias voltage having a polarity the reverse of the toner upon the transfer roller; thereby, it is also possible to return the reverse polarity toner, which adhered to the transfer roller, to the photoreceptor drum side.

In addition, the present invention according to the eighth constitution is an image forming device according to the first through seventh constitutions, wherein the impression of the bias voltage upon the transfer roller in the second return process is performed continuously for at least the time it takes the transfer roller to make one revolution; thereby, it is possible to sufficiently return the reverse polarity toner, which adhered to the transfer roller, to the photoreceptor drum side.

In addition, the present invention according to the ninth constitution is an image forming device according to any one of the first through eighth constitutions, comprising: a process that transports the toner from the toner carrier to the electrostatic latent image carrier side in accordance with changes in the temperature and/or the humidity inside and/or outside the device, and transports the transported toner to the transferring means side; and controls whether it is necessary to execute the return process that transports the toner, which was transported to the transferring means side, to the electrostatic latent image carrier side, and that controls the execution time; thereby, it is possible to execute the process in accordance with the environment in which the device is used, and to enable a speedy image forming process that effectively prevents image defects with a minimum execution time.

In addition, the present invention according to the tenth constitution is an image forming device according to any one of the first through ninth constitutions wherein the photoreceptor drum consists of an a-Si photoreceptor drum, thereby contributing to a longer photoreceptor life, a higher quality image from the image forming device, and a lower running cost.

BRIEF DESCRIPTION OF THE DRAWINGS

FIG. 7 is a table that lists the specifications of a photoreceptor drum, a transfer roller, and a developing unit of the image forming device used in the embodiments of the present invention.

DETAILED DESCRIPTION OF THE PREFERRED EMBODIMENTS

Figure 1:
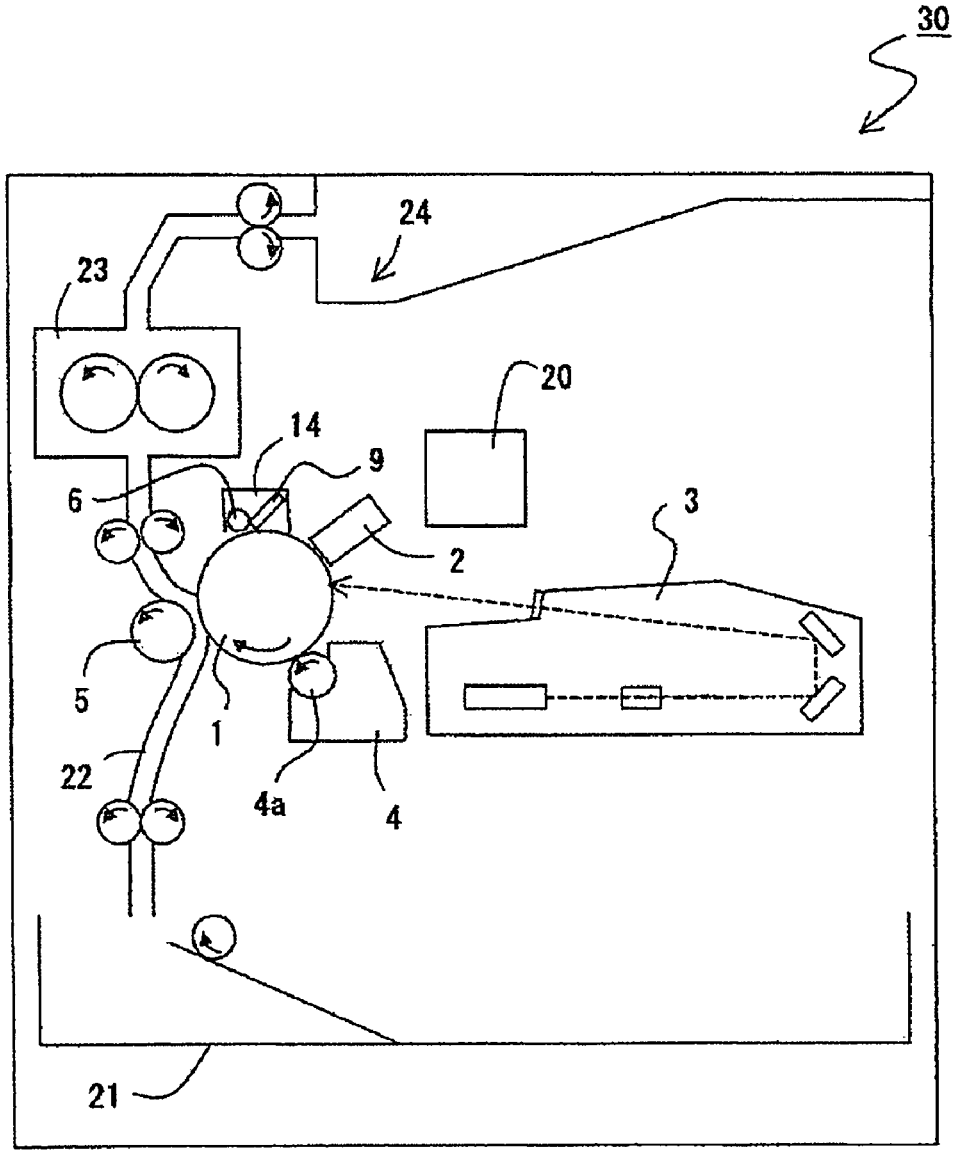
FIG. 1 is a schematic cross sectional view that depicts the entire constitution of an image forming device of the present invention.
Figure 9:
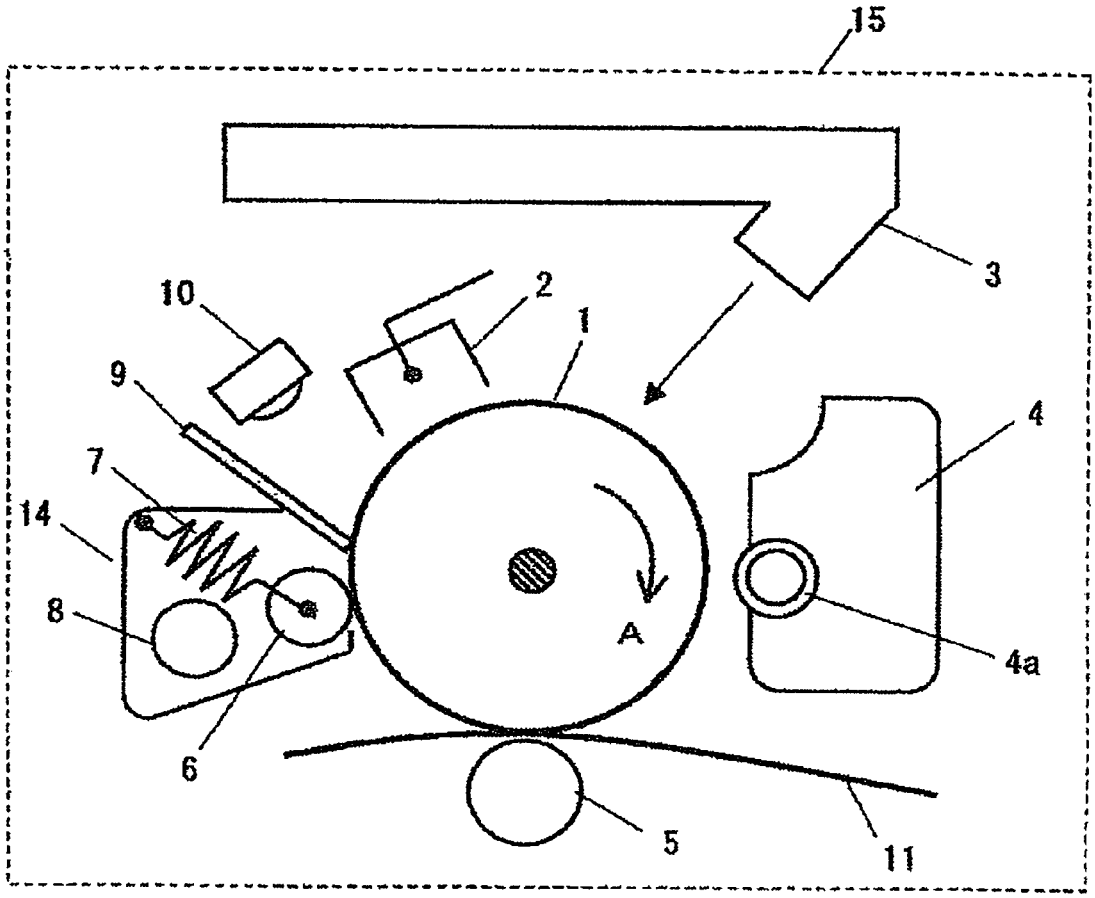
(Prior Art) Fig. 9
FIG. 9 is a schematic drawing that depicts the constitution of the image forming unit of a conventional image forming device.

The following explains the embodiments of the present invention, referencing the drawings. FIG. 1 is a schematic cross sectional view that depicts the constitution of an image forming device of the present invention. Parts in common with the conventional example in FIG. 9 are assigned the identical symbol, and the explanation thereof is omitted. An image forming device 30 comprises a photoreceptor drum 1 (electrostatic latent image carrier), a charging unit 2, an exposure unit 3, a developing unit 4, a transfer roller 5 (transferring means), a cleaning device 14, a toner storage unit 20, a sheet storage unit 21, a transport unit 22, a fusing unit 23, and a paper discharge unit 24.

The toner storage unit (hopper) 20 stores a developing agent (toner), and also supplies the developing agent to the developing unit 4 if the developing agent therein becomes insufficient. The sheet storage unit 21 stores sheets (paper, OHP transparencies, and the like), which are the recording media whereon images (toner images) are ultimately printed, and also feeds the sheets to the transport unit 22.

The transport unit 22 is the pathway of a sheet from the sheet storage unit 21 to the paper discharge unit 24. The fusing unit 23 converts the toner image transferred to the sheet into a stable permanent image, and fuses the toner image in the powder state by applying energy, e.g., heat and pressure. The paper discharge unit 24 stores the sheet that passed through the fusing unit 23, i.e., the sheet whereon the permanent image is printed and was that discharged outside of the device.

Furthermore, with such an image forming device 30, the exposure unit 3 irradiates the photoreceptor drum 1 with a laser beam (light beam) based on image data, and thereby forms an electrostatic latent image on the surface of that photoreceptor drum 1 based on that image data. Subsequently, the developing unit 4 adheres toner to the electrostatic latent image (to form a toner image), and the transfer roller 5 transfers that toner image onto a sheet. Next, the fusing unit 23 applies heat, and the like, to the sheet onto which that toner image was transferred, thereby converting it to a permanent image.

The first embodiment of the present invention is constituted capable of executing a refresh mode, which consists of: a process (toner discharge process) that transports toner (on a toner carrier) of a developing sleeve 4*a* inside the developing unit 4 to the photoreceptor drum 1 side when not transferring [the toner] to the recording medium; a process (transfer roller refresh process) that transports the toner, which was transported by the toner discharge process to the photoreceptor drum 1 side, to the transfer roller 5 side; and a process (hereinafter, referred to as the return process) that re-transports the toner, which was transported by the transfer roller refresh process to the transfer roller 5 side, to the photoreceptor drum 1 side.

The purpose of the abovementioned developing sleeve refresh process, which refreshes the developing sleeve 4*a*, is to prevent an image density reduction, fogging, and the like, which tend to occur when the document print ratio is low. With this refresh process, a control device, which comprises a central processing unit (CPU) and the like (not shown), that is inside the main body of the image forming device discussed above, calculates the image data as a dot count and then calculates the document print ratio an of the image; if the average print ratio A of the document print ratios a1, a2, a3, . . . , an for each page of the measured recording medium falls below 3%, then [the control device] stops image formation, transitions to the nontransfer state, and impresses a developing bias onto the developing sleeve 4*a* so that the toner thereon is developed to the photoreceptor drum 1 side and consumed. Furthermore, a case was explained in the present embodiment wherein image formation was stopped immediately; however, if continuous printing is in progress, image formation may be stopped after completion.

Figure 2:
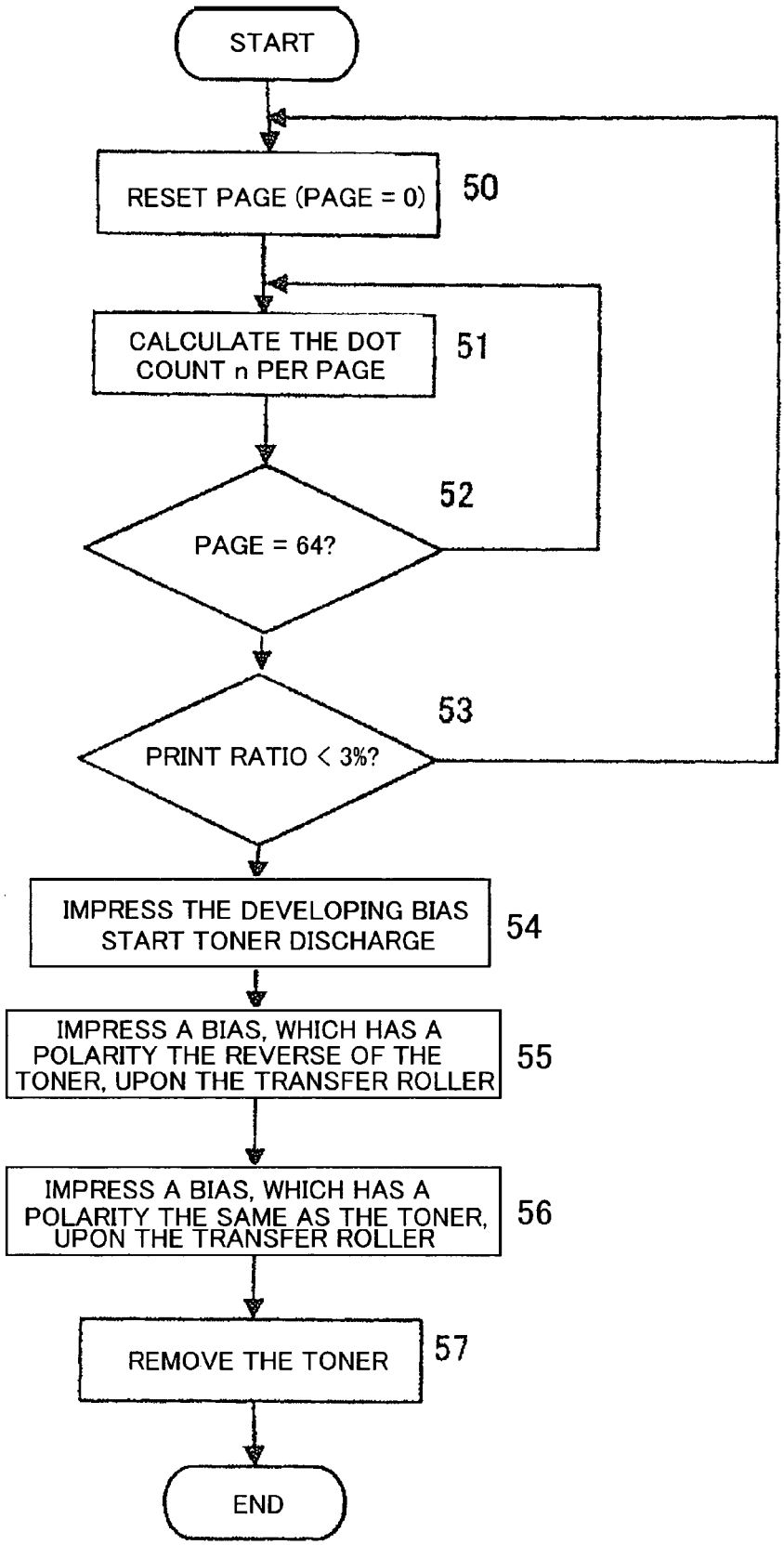
FIG. 2 is a flow chart that depicts a refresh mode of a first embodiment executed in the image forming device of the present invention.

The following explains the flow of the developing sleeve refresh process, referencing the flow chart depicted in FIG. 2. In the first stage in which the user operates the image forming device, the page counting means for counting the recording media is reset in the control device (not shown) (50), the print ratio of the image pattern and the dot count per page are computed for each image formation, and the dot count cumulative sum is stored along with the average print ratio (51).

Even if the prescribed page count (64 pages) is reached (52), the process returns to step 50 until the average print ratio A is less than 3% (53), whereupon the page count is reset but the print ratio and the average print ratio are continuously updated in step 51. Once again, 64 pages are counted (52) and, if the average print ratio A is less than 3% (53), then the developing bias is impressed for a period of 5.2 seconds, and the toner on the developing sleeve 4*a* is transported to the photoreceptor drum 1 side (hereinbelow, referred to as the toner discharge process) (54).

In the example explained above, the developing bias was impressed for a fixed time period when the average print ratio A was less than 3%, but the time for which the developing bias is impressed may vary by ranges of the average print ratio. For example, if A<0.5%, then the developing bias may be impressed for 15.0 seconds; if A<1%, then for 12.9 seconds; if A<2%, then for 10.5 seconds; and if A<3%, then for 5.2 seconds.

Next, the transfer roller 5 continues to roll for at least the time it takes to make one revolution, and a bias voltage, which has a polarity that is the reverse of the toner, is impressed upon the transfer roller 5 during that time (55). At this time, part of the discharged toner is transferred to the transfer roller 5 side, and the adherends on the transfer roller [5] are removed by the toner (hereinafter referred to as the transfer roller refresh process). Then, the transfer roller 5 continues to roll for at least the time it takes to make three revolutions, and a bias voltage, which has a polarity that is the same as the toner, is reimpressed (56), the return process is performed, wherein the toner that absorbed moisture, adherends, and the like, on the surface of the transfer roller 5 is transported to the photoreceptor drum 1 side, the returned toner is cleaned by a cleaning blade 9 (57), and the image forming operation is thereby performed.

The second embodiment of the present invention is constituted capable of executing the refresh mode, consisting of: a process (toner discharge process) that transports toner on the developing sleeve 4*a* inside the developing unit 4 to the photoreceptor drum 1 side when, for example, starting up the image forming device from the power supply off state, the sleep (energy saving) mode, and the like, to the copy start state when not transferring toner to the recording medium; a process (hereinafter referred to as the drum refresh process) that supplies the toner transported to the photoreceptor drum 1 by the toner discharge process to a sliding friction roller 6, and polishes the surface of the photoreceptor drum 1; a process (transfer roller refresh process) that transports the toner transported to the photoreceptor drum 1 side by the toner discharge process to the transfer roller 5 side; and a process (hereinafter referred to as the return process) that once again transports the toner transported to the transfer roller 5 side by the transfer roller refresh process to the photoreceptor drum 1 side.

Figure 3A:
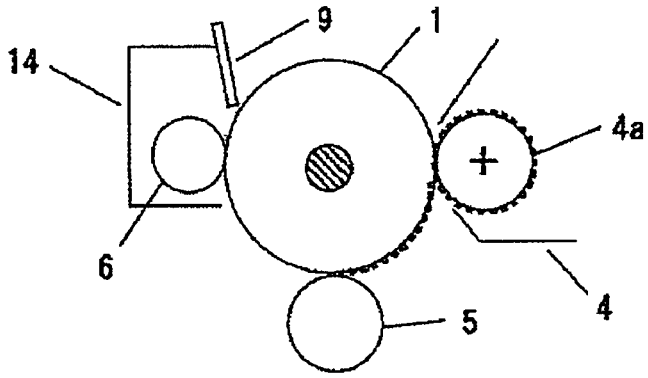
FIG. 3A to FIG. 3D are schematic drawings that depict states wherein an image forming unit of the image forming device of the present invention is in the refresh mode.

FIG. 3A to FIG. 3D are schematic views that depict an image forming unit of the image forming device of the present invention in the various process states during the refresh mode. Furthermore, for the convenience of the explanation, the recitation of the charging unit 2, the exposure unit 3, and a charge eliminating device 10 are herein omitted. FIG. 3A depicts a state wherein the image forming unit is performing the toner discharge process. The toner discharge process supplies the toner used in polishing the surface of the photoreceptor drum 1 from the developing unit 4 to the photoreceptor drum 1 side.

Figure 3B:
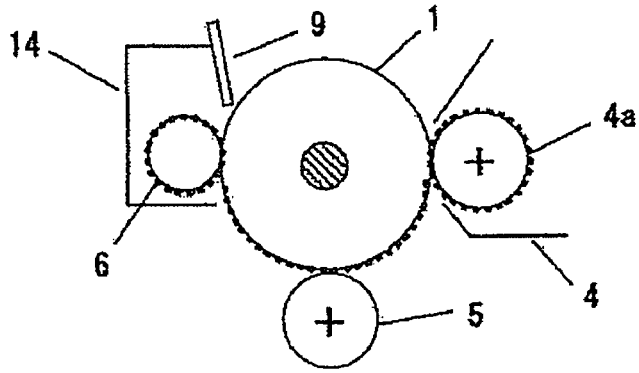

FIG. 3B depicts the state wherein the image forming unit is performing the drum refresh process. The purpose of the drum refresh process is to supply part of the toner, which was transported onto the photoreceptor drum 1 by the toner discharge process, to the sliding friction roller 6, polish the surface of the photoreceptor drum 1, and remove the moisture and contaminants along with the toner on the drum surface. Furthermore, while toner is being supplied to the sliding friction roller 6, a bias voltage, which has a polarity that is the same as the toner, is impressed upon the transfer roller 5 so that toner does not adhere thereto.

It is preferable at this time to set the time for which the bias voltage, which has the same polarity as the toner, is impressed upon the transfer roller 5 for at least the time needed for one revolution of the sliding friction roller 6, and to adhere the toner over the entire surface of the sliding friction roller 6. Subsequently, the cleaning blade 9 removes the toner from the drum surface, and a toner recovery device, such as a recovery screw 8, transports the toner to a waste bottle (not shown). Furthermore, the toner retransported by the return process, discussed later, from the transfer roller 5 side to the photoreceptor drum 1 side is also supplied to the sliding friction roller 6 and used in the drum refresh process.

Figure 3C:
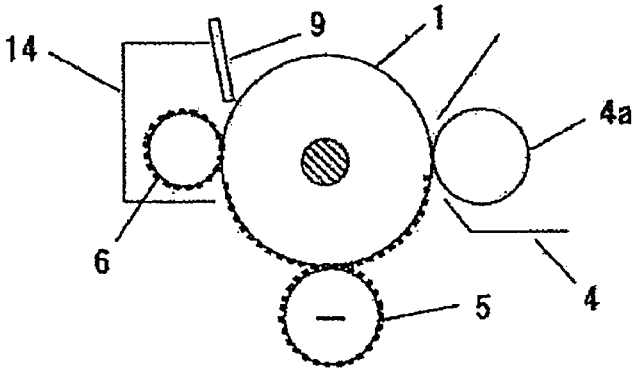

FIG. 3C depicts the state wherein the image forming unit is performing the transfer roller refresh process. The purpose of the transfer roller refresh process is to transport part of the toner, which was transported by the toner discharge process onto the photoreceptor drum 1, to the transfer roller 5 side, and remove the moisture from the surface of the transfer roller 5. The transport of the toner onto the transfer roller 5 is performed by impressing a bias voltage, which has a polarity that is the reverse of the toner, onto the transfer roller 5. It is preferable at this time to set the time for which the bias voltage, which has a polarity that is the reverse of the toner, is impressed to at least the time needed for one revolution of the transfer roller 5, and to adhere the toner over the entire surface of the transfer roller 5 in order to sufficiently absorb the moisture, adherends, and the like, on the transfer roller 5 into the toner.

Figure 3D:
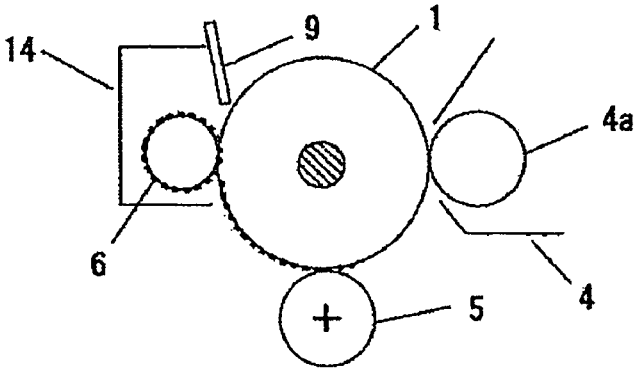

Subsequently, the return process is performed, wherein the toner that was transported to the transfer roller 5 side is once again transported to the photoreceptor drum 1 side. FIG. 3D depicts the state wherein the image forming unit is performing the return process. The retransport of the toner onto the photoreceptor drum 1 is performed by impressing a bias voltage, which has a polarity that is the same as the toner, onto the transfer roller 5. It is preferable to set the time of the return process to at least the time needed for three revolutions of the transfer roller 5. It is thereby possible to effectively prevent the blemishing on the reverse side of the recording medium due to residual toner on the surface of the transfer roller 5 because the toner on the transfer roller 5 side is completely transported to the photoreceptor drum 1 side.

Furthermore, it is preferable to return the reverse polarity toner remaining on the transfer roller 5 to the photoreceptor drum 1 side by providing a process (hereinafter referred to as the second return process) that once again impresses a bias voltage, which has a polarity that is the reverse of the toner, to the transfer roller 5 during the return process because some toner that is normally charged with reverse polarity also exists in the toner. It is also possible at this time to reliably prevent blemishing on the reverse side, due to the reverse polarity toner remaining on the surface of the transfer roller 5, by setting the time of the second return process to at least the time needed for one revolution of the transfer roller 5.

A feature of the present invention is that the photoreceptor drum 1 and the transfer roller 5 are simultaneously refreshed by using toner that was transported to the photoreceptor drum 1 side. It is thereby possible to refresh the developing sleeve 4*a*, the transfer roller 5, and the photoreceptor drum 1 in a short time period, as well as to effectively utilize the residual toner, which was discharged to the photoreceptor drum 1 side, on the developing sleeve 4*a*.

Figure 4:
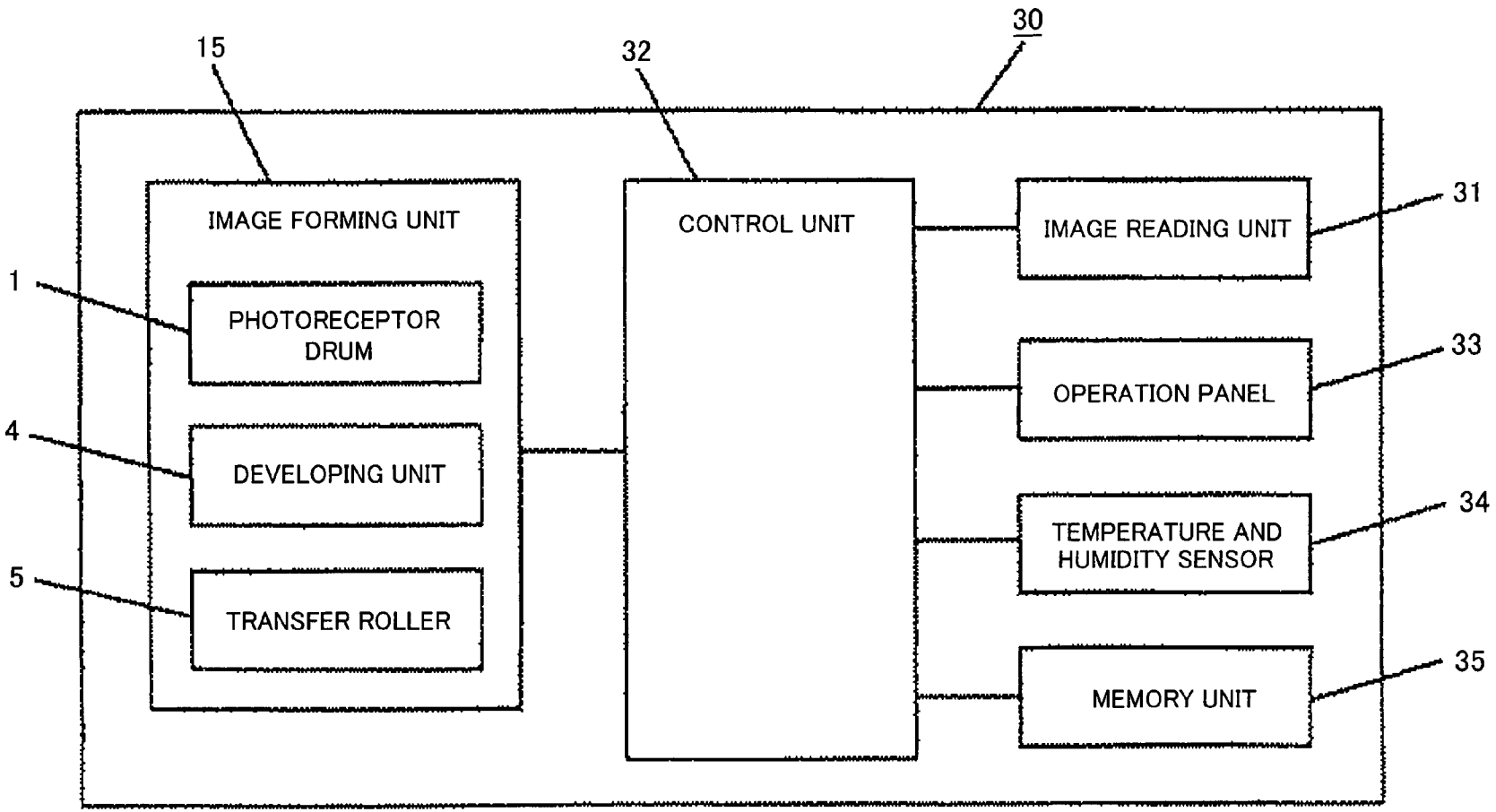
FIG. 4 is a block diagram that depicts one example of the constitution of the image forming device of the present invention.

FIG. 4 is a block diagram that depicts one example of the constitution of the image forming device of the present invention. The image forming device 30 comprises an image forming unit 15, an image reading unit 31, a control unit 32, an operation panel 33, a temperature and humidity sensor 34, and a memory unit 35.

The image reading unit 31 comprises a scanner, and the like, that reads the image data of the document during copying, and converts that image data to an image signal. The image signal read by the image reading unit 31 is sent to the control unit 32, which appropriately performs an image process, such as a gradation process, and converts the image signal to image data. The image forming unit 15 comprises the photoreceptor drum 1, the developing unit 4, the transfer roller 5, and the like, forms a latent image on the photoreceptor drum 1 based on the image data converted in the control unit 32, develops the latent image, and then transfers the toner image onto the paper. The control unit 32, in accordance with a set program, controls each of the units of the image forming device, such as the image reading unit 6 and the image forming unit 15.

The operation panel 33 comprises operation keys by which a user sets the device functions, printing conditions, and the like, and a display unit that displays the set conditions, the device status, and the like (both of which are not shown). The temperature and humidity sensor 34 constantly detects the temperature and humidity of the device interior every predetermined period of time, and sends the detected temperature and humidity to the control unit 32. The control unit 32 controls the refresh mode by changing the bias voltage impressed upon the developing sleeve 4*a* inside the developing unit 4 (refer to FIG. 3A through FIG. 3D), the transfer roller 5, and the like, based on the temperature and humidity of the device interior detected by the temperature and humidity sensor 34. As much as possible, the refresh mode is preferably controlled using the value detected immediately beforehand, but it may be controlled using the temperature and humidity detected in accordance with another timing. In addition, it is also possible to detect the temperature and humidity a predetermined number of times and to use the average value of those detected values.

The temperature and humidity sensor 34 is installed in the vicinity of, for example, the transfer roller 5, the sliding friction roller 6, the photoreceptor drum 1, and the like, but can also be installed at another location where it is possible to accurately detect the temperature and humidity of the inside and the outside of the device. The memory unit 35 stores the control program of each unit of the device used by the control unit 32. In addition, if the execution time of the refresh mode is changed in response to changes in the temperature and humidity detected by the temperature and humidity sensor 34, as discussed later, then the execution time of each process corresponding to the change in the temperature and humidity is also stored.

Figure 5:
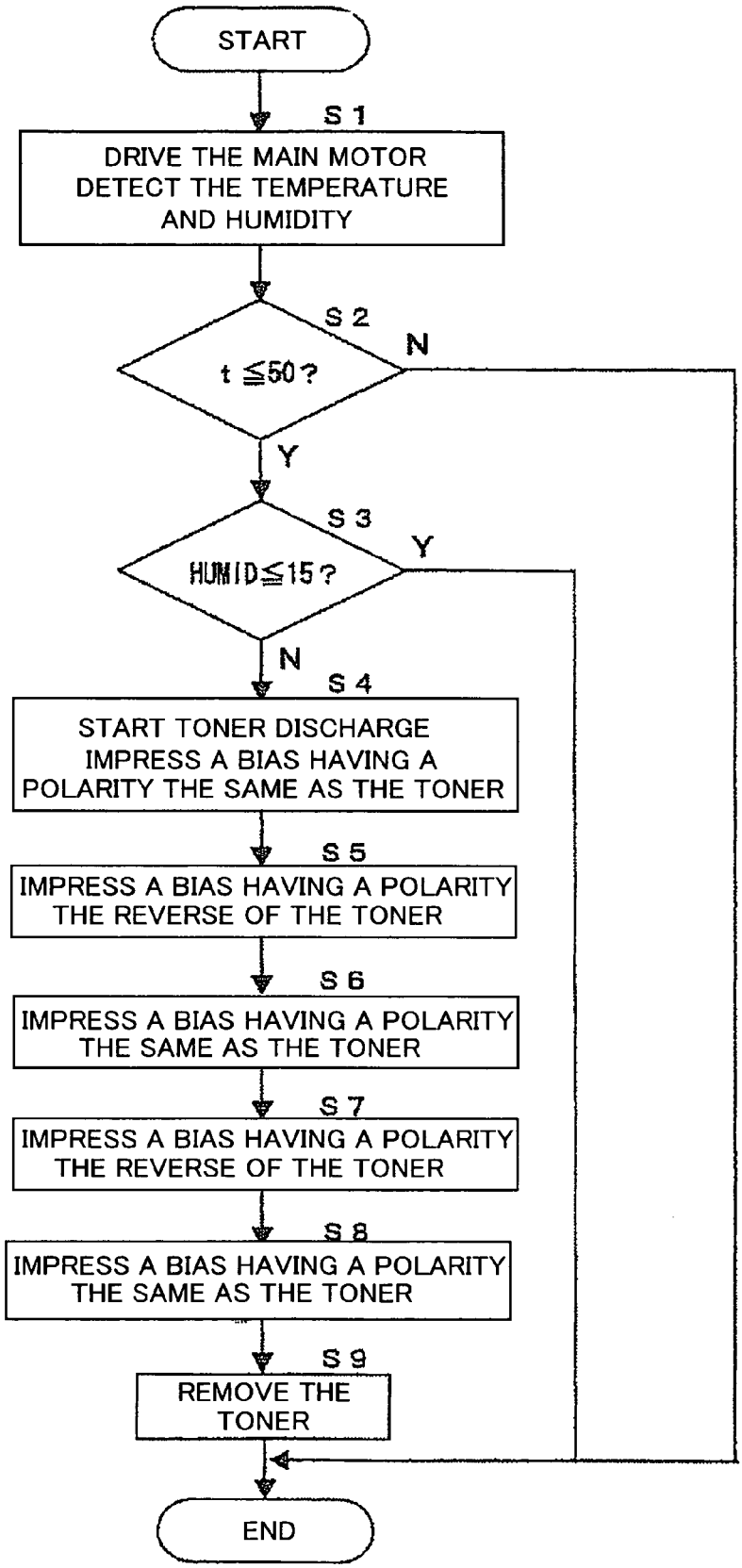
FIG. 5 is a flow chart that depicts the refresh mode of the second embodiment executed in the image forming device of the present invention.
Figure 6:
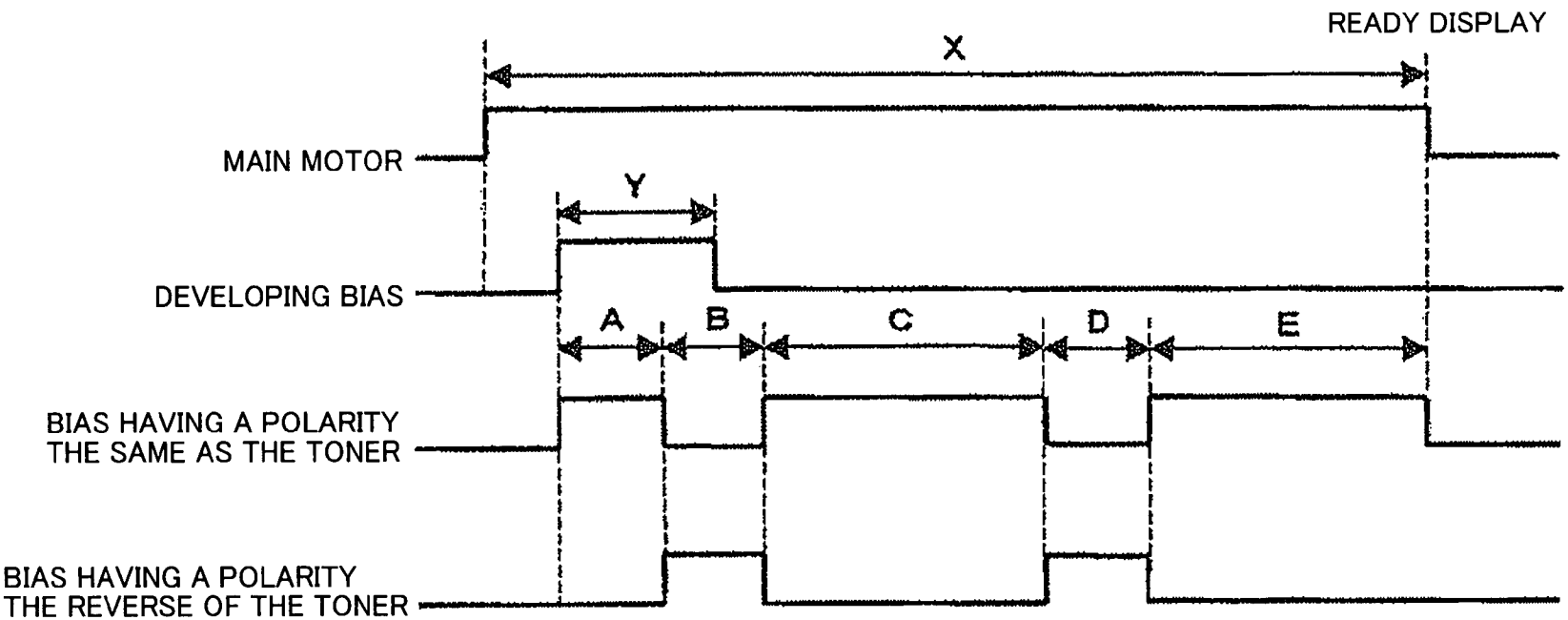
FIG. 6 is a timing chart that depicts the operation of the various units of the device in the refresh mode.

The following explains the operation of the image forming device of the present embodiment. FIG. 5 is a flow chart that depicts the toner discharge process, the drum refresh process, and the transfer roller refresh process executed in the image forming device of the present invention, and FIG. 6 is a timing chart that depicts the operation of each unit of the device in the refresh mode. Hereinbelow, the toner discharge process, the drum refresh process, and the transfer roller refresh process, which are performed sequentially, are generically referred to as the refresh mode. The controlling means of the refresh process will now be explained following the steps in FIG. 5 and referencing FIG. 6.

When starting up the image forming device from the power supply off state, the sleep (energy saving) mode, and the like, to the copy start state, first the main motor is driven (arrow X in FIG. 6), and simultaneous therewith the temperature and humidity of the inside and outside of the image forming device are detected by the temperature and humidity sensor 34 (step S1). The detected temperature and humidity are sent to the control unit 32, and it is determined whether the refresh mode needs to be executed based on the temperature (step S2). At this point, if the device power supply is turned off due to a paper jam, and the like, then the device is set so that the refresh mode is not executed if the difference (hereinafter referred to as the temperature t) between the temperature of the fusing thermistor and the ambient temperature is greater than 50°, i.e., if the device is already in a state capable of making copies, because processing will end up being delayed if the refresh mode is started.

If it is determined in step S2 that the temperature t is less than or equal to 50°, then it is determined, based on the humidity of the device interior, whether the refresh mode needs to be executed. At this point, it is determined whether to execute the refresh mode based on whether the amount of water vapor per 1 $m^3$ of air ($g/m^3$; hereinafter referred to as HUMID) exceeds a predetermined threshold value.

First, the process determines whether HUMID is less than or equal to 15 (step S3); if less than or equal to 15, then the process does not execute the refresh mode because the amount of moisture inside the device is small and image deletion will not occur. However, if HUMID is greater than 15 in step S3, then the discharge of the toner onto the photoreceptor drum 1 is started, slightly delayed from the start of the drive of the main motor, by impressing the developing bias onto the developing sleeve 4*a* (arrow Y in FIG. 6), and simultaneous therewith the sliding friction roller 6 continues to roll for at least the time it takes to make one revolution, and a bias voltage, which has a polarity that is the same as the toner, is impressed (arrow A in FIG. 6) upon the transfer roller 5 during that time (step S4). Thereby, toner does not adhere to the transfer roller 5, and a sufficient amount of toner used by the drum refresh process is supplied to the sliding friction roller 6.

Next, the transfer roller 5 continues to roll for at least the time it takes to make one revolution, and a bias voltage, which has a polarity that is the reverse of the toner, is impressed (arrow B in FIG. 6) upon the transfer roller 5 during that time (step S5). At this time, because the discharge of the toner onto the photoreceptor drum 1 is continuing, as depicted by the arrow Y in FIG. 6, part of the discharged toner is transported to the transfer roller 5 side, thereby performing the transfer roller refresh process. Then, the transfer roller 5 continues to roll for at least the time it takes to make three revolutions, and a bias voltage, which has a polarity that is the same as the toner, is once again impressed (the arrow C in FIG. 6) upon the transfer roller 5 during that time (step S6), thereby performing the return process, which transports the toner that absorbed the moisture on the surface of the transfer roller 5 to the photoreceptor drum 1 side.

After the sufficient amount of toner on the surface of the transfer roller 5 has returned to the photoreceptor drum 1 side by the return process, the transfer roller 5 continues to roll for at least the time it takes to make one revolution, and a bias voltage, which has a polarity that is the reverse of the toner, is once again impressed (arrow D in FIG. 6) upon the transfer roller 5 during that time (step S7), thereby performing the second return process, which returns the toner, which has a polarity that is the reverse of the surface of the transfer roller 5, to the photoreceptor drum 1 side. Then, a bias voltage, which has a polarity that is the same as the toner, is once again impressed (the arrow E in FIG. 6) on the transfer roller 5 for a predetermined time period, thereby performing the return process for a second time (step S8).

Thereby, the toner transported to the transfer roller 5 side is completely returned to the photoreceptor drum 1 side, and the blemishing on the reverse side of the paper is reliably prevented when forming an image after the refresh mode. Furthermore, although the return process is repeated twice herein, it may be performed only once or repeated three or more times. After the toner, which was returned to the photoreceptor drum 1 side by step S6 to step S8, is sent to the sliding friction roller 6 and used to refresh the drum, it is removed from the drum surface (step S9), which ends the refresh mode and completes the startup of the device. However, if the refresh mode is not performed, then the startup of the device is completed in the stage when the temperature of the fusing unit 23 (refer to FIG. 1) has stabilized.

By performing control based on the above procedure, it is possible to determine whether to perform the refresh mode in accordance with the temperature and humidity of the inside and outside of the device, to effectively prevent the occurrence of image deletion due to a humidity rise, to prevent the overpolishing of the drum surface, and to reduce the startup time of the image forming device by not performing an unnecessary refresh mode if the temperature is high or the humidity is low inside the device. Furthermore, although the start of the refresh mode was made automatic in response to the temperature and humidity herein, the refresh mode may also be executed manually as needed if image deletion occurs.

Furthermore, in the abovementioned embodiments, the refresh mode is controlled in accordance with the temperature and humidity detected by the temperature and humidity sensor 34, but the refresh mode can also be controlled by using a temperature sensor or a humidity sensor that detects either the temperature or the humidity, respectively, to measure the temperature or the humidity; or control may be performed to determine whether the refresh mode is needed, or only for the duration of one of the processes. In addition, the threshold value of the temperature or the humidity for determining whether the refresh mode needs to be performed, as well as the execution time of each process included in the refresh mode, can be flexibly set in accordance with the type, and the like, of the photoreceptor used.

EMBODIMENTS

Figure 8:
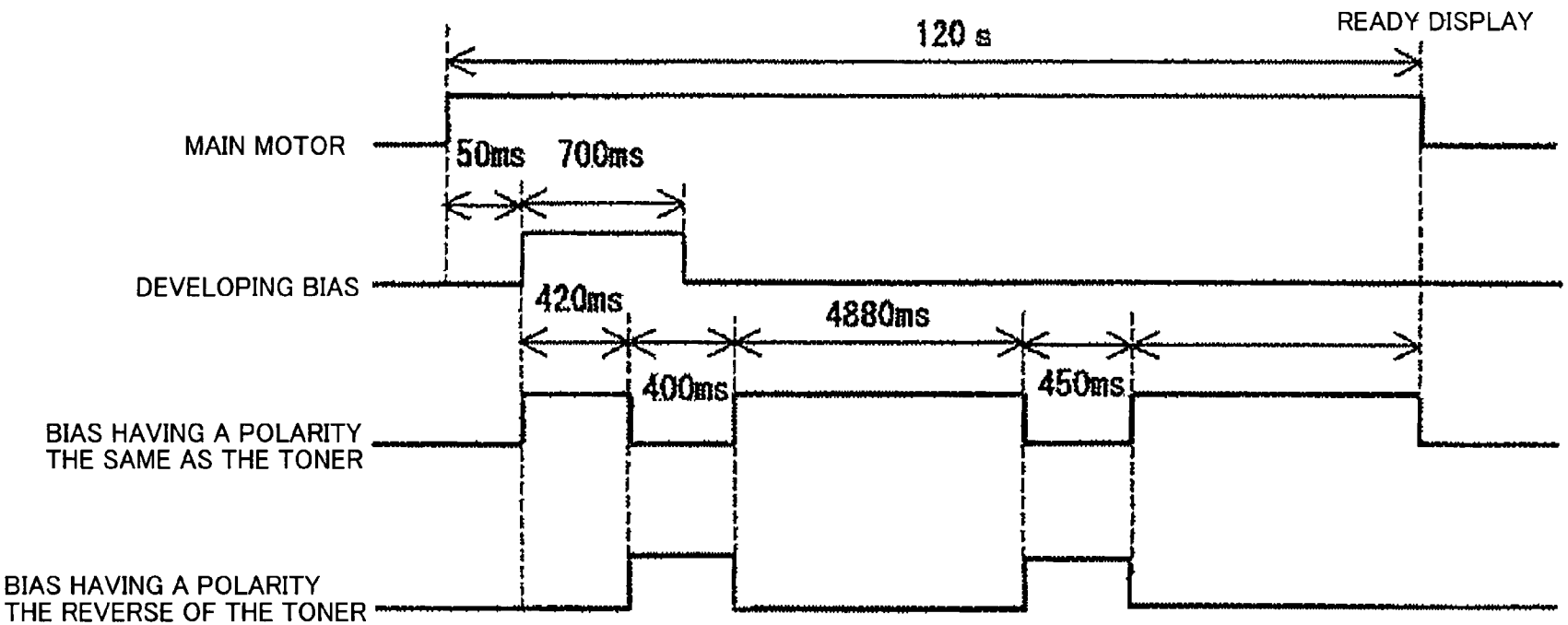
FIG. 8 is a timing chart that depicts the operation of the various units of the device in the refresh mode of the embodiments.

The following concretely explains, referencing the timing chart in FIG. 8, the refresh mode for the case wherein the specifications of the photoreceptor drum 1 and the transfer roller 5 in the image forming device, the developing bias value, and the transfer bias value are as listed in FIG. 7. In the present embodiment, the execution time of each process during the refresh mode (the development and transfer bias impressing times) are adjusted by partitioning them into the cases of $15<HUMID\leqq 25$ and $25<HUMID$. Here, if $15<HUMID\leqq 25$, then the execution time of the refresh mode is set to 120 s, and the time for which the development bias is impressed (the toner discharge time) upon the developing sleeve 4*a* is set to 700 ms.

After 50 ms from the start of the drive to stabilize the drive of the main motor, a developing bias of 200 V is impressed upon the developing sleeve 4*a* for 700 ms, and the toner is discharged onto the photoreceptor drum 1. Simultaneous with the discharge of the toner, a bias voltage (+590 V), which has a polarity that is the same as the toner, is impressed upon the transfer roller 5 for 420 ms, thereby preventing the adhesion of the toner onto the transfer roller 5, and supplying toner for refreshing the drum to the sliding friction roller 6.

Next, a bias voltage (−20 μA), which has a polarity that is the reverse of the toner, is impressed upon the transfer roller 5 for 400 ms. Because the discharge of the toner from the developing sleeve 4*a* continues until the impressing of the bias voltage, which has a polarity that is the reverse of the toner, is in progress, part of the discharged toner adheres to the transfer roller 5 and absorbs the moisture on the surface thereof. Subsequently, a bias voltage (+590 V), which has a polarity that is the same as the toner, is impressed upon the transfer roller 5 for 4,880 ms, and the toner that adhered to the transfer roller 5 is re-adhered to the photoreceptor drum 1 side. Then, the re-adhered toner is successively supplied to the sliding friction roller 6 and used to polish the surface of the photoreceptor drum 1, and is subsequently removed from the drum surface by the cleaning blade 9.

Furthermore, a bias voltage (−20 μA), which has a polarity that is the reverse of the toner, is impressed for 450 ms, and the reverse polarity toner is also re-adhered to the photoreceptor drum 1 side. At this time, because the same polarity toner that was transported previously to the photoreceptor drum 1 side has already been removed from the drum surface, it does not re-adhere to the transfer roller 5 side. Then, to prevent the blemishing on the reverse side of the paper when forming an image, a bias voltage (+590 V), which has a polarity that is the same as the toner, is once again impressed for just the remaining time, which completely removes the toner that adhered to the transfer roller 5 and completes the refresh mode.

If the humidity inside the device becomes high, the time needed to refresh the photoreceptor drum 1 and the transfer roller 5 will also lengthen, which will require a commensurately greater amount of toner to discharge from the developing sleeve 4*a*. Consequently, if 25<HUMID, the execution time of the refresh mode is set to 150 s, the time for which the development bias is impressed upon the developing sleeve 4*a* (toner discharge time) is set to 1,000 ms, and the time for which the bias voltage is impressed in each process is set longer to match the time of the entire refresh mode. The explanation of the controlling means is omitted because it is the same as in the case of 15<HUMID≦25.

Furthermore, if the main motor drive time (refresh mode execution time) for the case of 15<HUMID≦25 in the above-mentioned embodiment is set to 120 s, and the developing bias impressing time (toner discharge time) is set to 700 ms, then the main motor drive time can be set appropriately in the range of 50 to 150 s, and the developing bias impressing time can be set appropriately in the range of 500 to 1000 ms.

What is claimed is:

1. An image forming method for an image forming device having an electrostatic latent image carrier, developing means having a toner carrier, the developing means forming a toner image on the electrostatic latent image carrier surface by toner carried on the toner carrier, and transferring means transporting a toner image on the electrostatic latent image carrier to a recording medium, comprising:

a toner discharge process that transports toner having a specific polarity from the toner carrier to the electrostatic latent image carrier;

a first refresh process that transports the toner having the specific polarity on the electrostatic latent image carrier being transported between the toner carrier and the transferring means to the transferring means by impressing upon the transferring means a voltage having a polarity opposite that of the toner having the specific polarity, and makes the toner having the specific polarity absorb adherends adhered to the transferring means; and a return process that transports the toner having the specific polarity that has absorbed the adherends on the transferring means to the electrostatic latent image carrier by impressing upon the transferring means a voltage having a polarity that is the same as the toner having the specific polarity on the transferring means.

2. The image forming method as recited in claim 1, wherein the transferring means is a transfer roller.

3. The image forming method as recited in claim 2, wherein the impression of the voltage upon the transfer roller in the first refreshing process is performed continuously for at least the time it takes the transfer roller to make one revolution.

4. The image forming method as recited in claim 1, further comprising a second refresh process that presses against a sliding friction roller to the surface of the electrostatic latent image carrier, and polishes the surface of the electrostatic latent image carrier with the toner supplied to the electrostatic latent image carrier.

5. The image forming method as recited in claim 4, wherein the supply of the toner to the sliding friction roller is performed continuously at least for the time it takes the sliding friction roller to make one revolution.

6. An image forming method for an image forming device including an electrostatic latent image carrier, developing means having a toner carrier, the developing means forming a toner image on a surface of the electrostatic latent image carrier, and transferring means transporting the toner image on the electrostatic latent image carrier onto a recording medium, comprising:

a toner discharge process that transports toner from the toner carrier to the electrostatic latent image side;

a first refresh process that transports the toner that was transported to the electrostatic latent image carrier side to the transferring means side by impressing upon the transferring means a voltage having a polarity opposite that of the toner, and makes the toner absorb the adherends adhered to the transferring means by the transported toner; and a return process that transports the toner that absorbed the adherends adhered to the transfer roller to the electrostatic latent image carrier side by impressing a voltage having a polarity that is the same as the toner upon the transfer roller continuously for at least the time it takes the transfer roller to make three revolutions.

7. The method as recited in claim 6, further comprising a second refresh process that presses a sliding friction roller against the surface of the electrostatic latent image carrier, and polishes the surface of the electrostatic latent image carrier with the toner supplied by the toner discharge process.

8. An image forming method for an image forming device including an electrostatic latent image carrier, developing means having a toner carrier, the developing means forming a toner image on a surface of the electrostatic latent image carrier, and transferring means transporting the toner image on the electrostatic latent image carrier onto a recording medium, comprising:

a toner discharge process that transports toner having a specific polarity from the toner carrier to the electrostatic latent image carrier;

a first refresh process that transports the toner having the specific polarity on the electrostatic latent image carrier being transported between the toner carrier and the transferring means to the transferring means by impressing upon the transferring means a voltage having a polarity opposite that of the toner having the specific polarity, and makes the toner having the specific polarity absorb the adherends adhered to the transferring means;

a first return process that transports the toner that absorbed the adherends adhered to the transferring means to the electrostatic latent image carrier by impressing a voltage upon the transferring means having a polarity opposite that of the toner having the specific polarity on the transferring means; and a second return process that impresses a voltage on the transferring means having a polarity opposite that of toner having a polarity opposite that of the specific polarity on the transferring means.

9. The method as recited in claim 8, further comprising a second refresh process that presses a sliding friction roller against the surface of the electrostatic latent image carrier, and polishes the surface of the electrostatic latent image carrier with the toner supplied by the toner discharge process.

10. The method as recited in claim 8, wherein the transferring means is a transfer roller.

11. The method as recited in claim 10, wherein the impression of the voltage upon the transfer roller in the first return process is performed continuously at least for the time it takes the transfer roller to make three revolutions.

12. The method as recited in claim 10, wherein the impression of the voltage upon the transfer roller in the second return process is performed continuously at least for the time it takes the transfer roller to make a revolution.

13. An image forming device, comprising:

an electrostatic latent image carrier having a surface;

exposing means writing an electrostatic latent image on the surface of the electrostatic latent image carrier;

developing means having a toner carrier, the developing means forming toner images onto the surface of the electrostatic latent image carrier by toner carried on the toner carrier;

transferring means transporting the toner image on the surface of the electrostatic latent image carrier obtained from the developing means onto a recording medium;

fusing means fusing the toner image on the recording medium; and controlling means performing refreshment of the image forming portions including the electrostatic latent image carrier, the developing means, and the transferring means, the controlling means being configured to determine whether it is necessary to execute any of the processes the processes including a toner discharge process that transports toner having a specific polarity from the toner carrier to the electrostatic latent image carrier, a first refresh process that transports the toner having the specific polarity on the electrostatic latent image carrier being transported between the toner carrier and the transferring means side to the transferring means by impressing upon the transferring means a voltage having a polarity opposite that of the toner having the specific polarity, and makes the toner having the specific polarity absorb the adherends adhered to the transferring means by the transported toner having the specific polarity, and a return process that transports the toner having the specific polarity that absorbed the adherends adhered to the transferring means to the electrostatic latent image carrier by impressing upon the transferring means a voltage having a polarity the same as the toner having the specific polarity on the transferring means.

14. The image forming device as recited in claim 13, further comprising detecting means that detects the temperature and/or the humidity of the inside and/or the outside of the device, and the controlling means determines whether it is necessary to execute any of the processes in accordance with the detecting results of the detecting means, and controls the execution time of each process in accordance with the results of the detecting means.

15. The image forming device as recited in claim 14, wherein the electrostatic latent image carrier consists of amorphous silicon.

* * * * *